United States Patent [19]

Scalzo

[11] Patent Number: 4,586,611

[45] Date of Patent: May 6, 1986

[54] BUSINESS MAILER

[75] Inventor: Arthur C. Scalzo, Irondequoit, N.Y.

[73] Assignee: Specialized Printed Forms, Inc., Caledonia, N.Y.

[21] Appl. No.: 743,099

[22] Filed: Jun. 10, 1985

[51] Int. Cl.[4] ..... B65D 27/38

[52] U.S. Cl. ..... 206/610; 206/632; 229/69

[58] Field of Search ..... 229/69; 206/610, 629, 206/632

[56] References Cited

U.S. PATENT DOCUMENTS

| | | | |
|---|---|---|---|
| 3,104,799 | 9/1963 | Steidinger | 229/69 |
| 3,211,469 | 10/1965 | Chamberlain | 229/69 |
| 3,229,894 | 1/1966 | Rosenthal | 206/610 |
| 3,297,235 | 1/1967 | Robbins | 206/610 |
| 4,193,501 | 3/1980 | Allen | 229/69 |
| 4,361,269 | 11/1982 | Newbauer | 229/69 |
| 4,384,670 | 5/1983 | Dicker | 229/69 |

*Primary Examiner*—William I. Price
*Assistant Examiner*—Gary E. Elkins
*Attorney, Agent, or Firm*—Cumpston & Shaw

[57] ABSTRACT

An improved business mailer having an insert wherein one end is free of the mailer and the opposite end is secured to an edge region thereof. The insert has a tear strip defined by at least one detachable edge adjacent its opposite secured end. The mailer has a tear tab portion secured to the tear strip whereby removal of the tear tab portion to open the mailer also removes the tear strip to release the insert. The mailer may also have a plurality of inserts containing information in which two folded inserts in connected superimposed relation are provided with information visible thereon from the front and rear. Withdrawal from the mailer of the insert having the information visible thereon from the front of the folded inserts causes the other insert to lag behind, slowly unfolding and reversing so that the business information formerly visible from the rear of the folded inserts is now noticeably visible from the front.

9 Claims, 6 Drawing Figures

BUSINESS MAILER

BACKGROUND OF THE INVENTION

1. Field of the Invention

This invention relates generally to mailers, and more particularly to an improved business mailer containing at least one insert secured to the mailer which is released when the mailer is opened. Withdrawal of the released insert from the mailer causes another insert connected to the released insert to unfold and reverse in lagging relation so that any printed information thereon formerly visible from the rear is now visible from the front.

2. Description of the Prior Art

A business mailer is disclosed in U.S. Pat. No. 4,157,759 having a tear tab portion defined by an edge of the mailer and a tear line on the rear panel thereof. The tab portion is removable for exposing a statement and a return mail envelope within a pocket defined by the front and rear panels of the mailer. Removal of the mailer tab portion removes an attached tear tab strip along a tear line on the rear panel of the return mail envelope, releasing the envelope.

U.S. Pat. No. 4,212,396 describes an envelope for inserts or the like having a tear strip defined by tear lines for opening the envelope and exposing the contents therein. The envelope further has chip elements underlining the tear strip for immobilizing the insert within the envelope. The chip elements are secured to the tear strip and are removable from the insert upon removal of the tear strip.

A single ply, multi-panel envelope form is disclosed in U.S. Pat. No. 3,955,750. The envelope form comprises a pair of coplanar, envelope-defining panels, and a plurality of intermediate panels disposed between and in end-connected zig-zag folded relationship with the envelope-defining panels.

Still another business mailer is known in the art having a tear tab portion defined by a pair of spaced tear lines adjacent one end of a back panel of the mailer. Removal of the tear tab portion opens the mailer exposing the free ends of a reply mailer, a statement and a carbon, all arranged in superimposed relation.

SUMMARY OF THE INVENTION

In accordance with a preferred embodiment of the invention, an improved business mailer is disclosed comprising front and back panels joined along four edge regions thereof by glue or the like to define an enclosed pocket therebetween. A first insert is disposed in the pocket with one end free and its opposite end secured to a first edge region of the front and back panels. The first insert further has a first tear strip having a pair of spaced detachable edges, such as tear lines, located adjacent its opposite secured end. The mailer further has a tear tab portion on one of the front and back panels adjacent the first edge region thereof for opening the mailer and exposing the inserts therein. The tear tab portion has a pair of spaced detachable edges, such as tear lines, and the first tear strip is secured to the underside of the tear tab portion. Accordingly, removal of the tear tab portion from the mailer also removes the first tear strip severing the secured end of the first insert.

In another aspect of the invention, a second insert is disposed in the pocket having one end integrally connected in folding relation along a fold line to the panel free end of the first insert. The opposite end of the second insert is secured to the first edge region of the front and back panels. The second insert further has printed information thereon facing the other of the front and back panels, and a tear line adjacent the secured end.

When the mailer is opened by the aforementioned tear tab portion and the severed end of the first insert is grasped and withdrawn from the mailer, the second insert is automatically withdrawn and slowly unfolded and reversed. This results in the printed information on the second insert to now face the opposite direction where it is visible to the person removing the first and second inserts from the mailer.

In another aspect of the invention, a third insert is disposed in the pocket between the first and second inserts, and has printed information thereon facing one of the front and back panels. The third insert has one end free and its opposite end secured to the first edge region of the front and back panels. The third insert further has a second tear strip adjacent its opposite secured end having a pair of spaced detachable edges, such as tear lines. The second tear strip is secured to the underside of the first tear strip on the tear tab portion. Accordingly, removal of the tear tab portion from this mailer also removes the first and second tear strips severing the secured ends of the first and third inserts respectively.

In a further aspect of the invention, a fourth insert is disposed in the pocket between the first insert and one of the front and back panels, and has printed information thereon facing one of the front and back panels. The fourth insert has one end free, and its opposite end secured to the first edge region of the front and back panels. The fourth insert further has a third tear strip adjacent its opposite secured end having a pair of spaced detachable edges, such as tear lines. The third tear strip is interposed between the tear tab portion and the first tear strip with the surfaces thereof secured together.

In a more specific aspect of the invention, the tear tab portion is on the front panel. The printed information on the first insert faces the front panel, and the printed information on the second insert faces the back panel. When the first insert is withdrawn from the pocket, the second insert integrally connected thereto along the fold line is withdrawn, unfolded and reversed with the printed information thereon now facing the front panel.

One of the primary advantages of the improved business mailer of this invention is to retain a plurality of sheets of insert material in fixed registration with overlapping ends thereof secured to one end of the mailer during mail handling and delivery. All but one sheet is released when the mailer is opened by removing a tear tab portion from the mailer.

Another advantage of the improved business mailer of this invention is to cause an insert which is secured at one end to the mailer to unfold, reverse and lag behind the other unsecured inserts when the unsecured inserts are withdrawn from the mailer. This makes the secured insert much more noticeable than the unsecured inserts, and calls attention to any printed information thereon.

Another advantage of the business mailer is to reduce advertising costs by combining therein advertising, promotional and business materials.

The invention and its advantages will become more apparent from the detailed description of the invention presented below.

BRIEF DESCRIPTION OF THE DRAWINGS

In the detailed description of the invention presented below, reference is made to the accompanying drawings, in which.

DETAILED DESCRIPTION OF THE INVENTION

Figure 1:
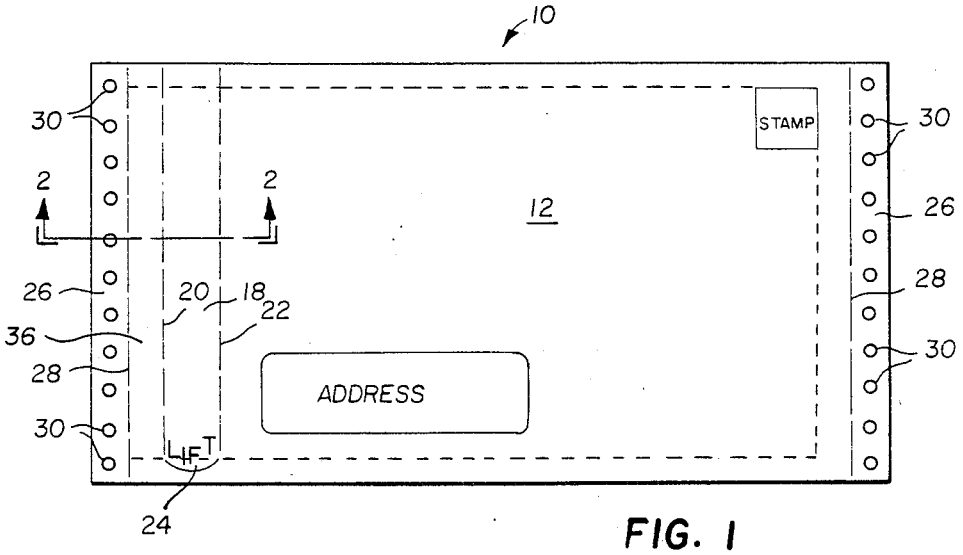
FIG. 1 is a top plan view of a preferred embodiment of the improved business mailer of this invention.
Figure 2:
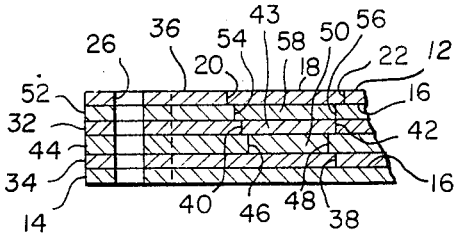
FIG. 2 is a greatly enlarged segmental section view taken substantially along line 2—2 of FIG. 1.

Referring now to FIGS. 1-4 of the drawings, a preferred embodiment of the business mailer 10 of this invention comprises front and back paper panels 12, 14 respectively secured together along edge regions by any suitable adhesive or glue to form a pocket 16 therebetween (FIG. 2). Within the pocket are disposed a plurality of inserts, to be described hereinafter, containing printed material, such as, for example, a business statement, a reply card or envelope and advertising or promotional material. While a particular embodiment of this invention is described herein for the purposes of illustrating the invention, it will be appreciated that the invention is not so limited, for example, the number and type of inserts may be changed as necessary. The front panel 12 has a tear tab portion 18 having a pair of spaced detachable edges, such as a pair of spaced tear lines 20, 22, for example. Tear tab portion 18 has a free flap 24 at one end formed by an arcuate cut line in the front panel 12 by which the tab portion can be removed from the front panel to provide access to pocket 16. Alternatively, the tab portion can be provided with an equivalent structure comprising edges overlapping an elongated rectangular opening extending across the width of the mailer. The overlapping edges of the tab portion would be releasably secured to edges of the opening by glue or the like.

In the manufacture of the mailer 10, the panels 12, 14 and inserts are transported through the assembly stations by edge strips 26 (FIG. 1) connected to the mailer along tear lines 28. The edge strips 26 and mailer 10 are transported by any suitable means, such as rotatably driven cog wheels, pin feed tractors or pin wheels, not shown, engageable with spaced perforations 30 in the edge strips. The edge strips 26 are useful in feeding the mailer through a computer printer or word processor, but are preferably removed prior to mailing.

Figure 5:
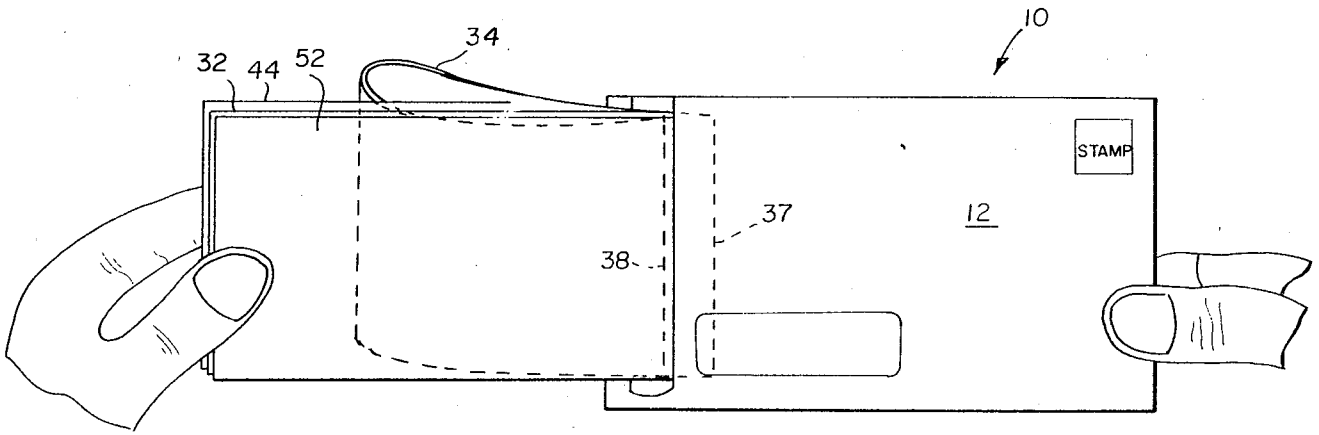
FIG. 5 is a top plan view of the mailer with the tear tab portion removed and the inserts almost fully withdrawn therefrom.
Figure 6:
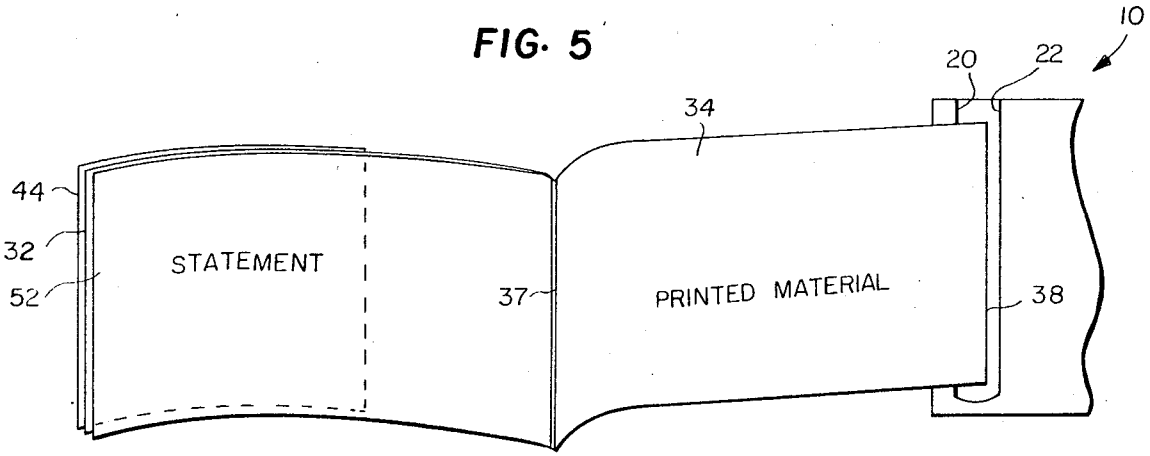
FIG. 6 is a top plan view similar to FIG. 5 showing the inserts fully withdrawn from the mailer, and the lowermost insert unfolded and reversed with the printed information visible thereon.

The first and second inserts (FIG. 2) comprise a pair of overlapped paper sheets 32, 34 respectively secured at one of their ends to an edge region 36 of the front and back panels 12, 14. The opposite ends of the inserts are joined together by any convenient means such as by gluing both parts along a line 37 or formed of a single folded piece or two pieces as best seen in FIGS. 5 and 6, and are free of the panels. The width of the inserts 32, 34 is less than the distance between the oppositely sealed edge regions of the mailer so that the inserts, when unsecured from edge region 36, are freely movable out of pocket 16. The first insert 32 has a pair of spaced tear lines 40, 42 (FIG. 2) defining a strip 43 extending across the full width of the insert. The first insert 32 further has printed material on the surface thereof facing front panel 12. The second insert 34 is disposed within the pocket adjacent back panel 14 and has a tear line 38. Second insert 34 further has printed material on the surface thereof facing back panel 14.

A third insert 44 is disposed between the first and second inserts 32, 34 (FIG. 2), and may define by tear lines, not shown, a business reply card, for example. The third insert 44 is shown (FIGS. 5 and 6) as being substantially shorter than and of substantially the same width as the first and second inserts. The third insert 44 is also made from a thicker and more rigid paper to provide a reply card suitable for mailing. The third insert 44 is secured at one end to edge region 36 of the front and back panels 12, 14, and its opposite end is free. Third insert 44 has a pair of spaced tear lines 46, 48 (FIG. 2) defining a strip 50 extending across its full width.

The mailer 10 may also contain a fourth paper insert 52 (FIG. 2), such as a statement, for example, of substantially the same size as one of the first and second inserts. The fourth insert 52 is interposed between front panel 12 and first insert 32. One end of the fourth insert is secured to end region 36, and its opposite end is free of the panels 12, 14. Fourth insert 52 also has a pair of spaced tear lines 54, 56 (FIG. 2) defining a strip 58 extending across its full width.

Figure 4:
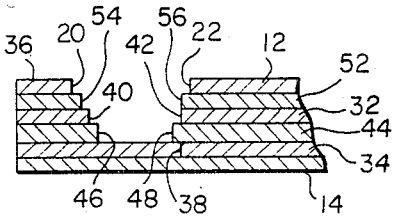
FIG. 4 is a greatly enlarged segmental section view taken substantially along line 4—4 of FIG. 3.
Figure 3:
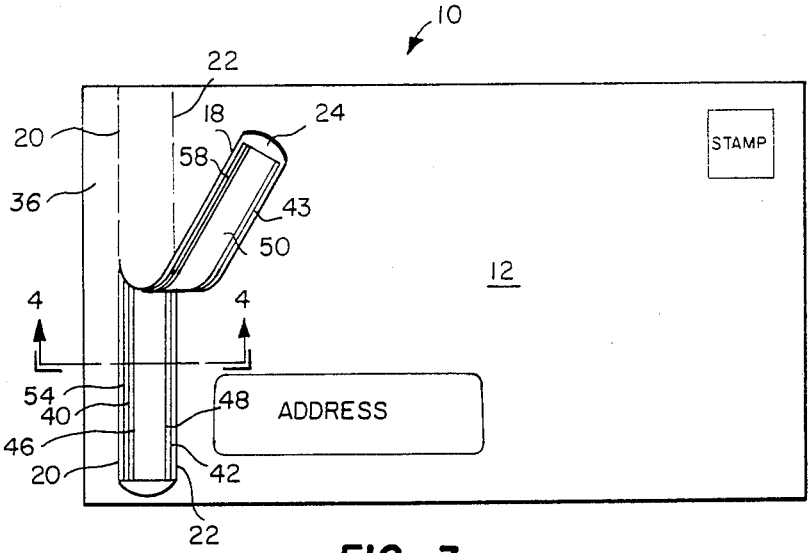
FIG. 3 is a view similar to FIG. 1 showing the tear tab portion partially removed from the mailer.

All of the strips 58, 43, 50 defined by their respective tear lines are of narrowing width, as best seen in FIG. 2, and are secured together by adhesive or the like and to the underside of tear tab portion 18. Accordingly, when the flap 24 is grasped and tear tab portion 18 removed, as best seen in FIGS. 3 and 4, all of the tear strips 58, 43, 50 are also removed to free inserts 52, 32, 44 respectively previously secured together along edge region 36. The person opening mailer 10 can grasp one end of the mailer between thumb and forefinger of the right hand, and the free ends of the first, third and fourth inserts 32, 44, 52 respectively between the thumb and forefinger of the left hand, as seen in FIG. 5, and pull the inserts out of pocket 16. Since first insert 32 is connected to second insert 34 at line 37, the second insert also begins to move outwardly at a slower rate, with the fixed end thereof initially folding on its tear line 38. Further outward movement of the first, third and fourth inserts, as seen in FIG. 6, completely unfolds and reverses second insert 34, exposing the printed advertising or promotional material formerly facing back panel 14 (now facing front panel 12 and the person opening the mailer). Accordingly, the printed advertising or promotional material is very noticeable such that the full attention of the person opening the mailer is directed to it.

While a preferred embodiment of the invention has been shown and described with particularity, it will be appreciated that various changes and modifications may suggest themselves to one having oridinary skill in the art upon being apprised of the present invention. It is intended to encompass all such changes and modifications as fall within the scope and spirit of the appended claims.

What is claimed:

1. An improved business mailer comprising in combination:

a front panel;

a back panel secured to said front panel along selected edge regions thereof to define an enclosed pocket therebetween;

an insert disposed in said pocket, said insert having one end free of said panels and its opposite end secured to one of said edge regions of said front and back panels;

a tear strip on said insert having a pair of spaced detachable edges adjacent said opposite secured end of said insert; and a tear tab portion having a pair of spaced detachable edges on one of said front and back panels adjacent said one edge region, said tear tab portion overlapping said tear strip and secured thereto whereby removal of said tear tab portion from the mailer opens the mailer and removes said tear strip for releasing said opposite secured end of said insert so that said insert is free to be withdrawn from said pocket.

2. The business mailer according to claim 1 wherein a plurality of inserts is disposed in said pocket, each insert having a tear strip secured to said tear tab portion whereby removal of said tear tab portion removes said tear strip for releasing said insert.

3. The business mailer according to claim 1 wherein said spaced detachable edges on each of said tear strip and tear tab portion comprise tear lines.

4. An improved business mailer comprising in combination:

a front panel;

a back panel secured to said front panel along selected edge regions thereof to define an enclosed pocket therebetween;

a first insert disposed in said pocket and having printed information thereon facing one of said front and back panels and having one end free of said panels and its opposite end secured to one of said edge regions of said front and back panels;

a second insert disposed in said pocket and having printed information thereon facing the other of said front and back panels, and having one end free of said panels, and the opposite end of said second insert is secured to said one edge region of said front and back panels;

a first tear strip having a pair of spaced detachable edges on at least one of said first and second inserts adjacent said opposite ends of said first and second inserts; and a tear tab portion having a pair of spaced detachable edges on one of said front and back panels adjacent said one edge region, and arranged to overlap said first tear strip, said first tear strip being secured to said tear tab portion whereby removal of said tear tab portion and said tear strip from the mailer releases said opposite secured end of said one of said first and second inserts and exposes said first and second inserts.

5. The business mailer according to claim 4 wherein said second insert has a detachable edge adjacent said opposite secured end thereof, said one end of said second insert is integrally connected in folded relation to said panel free end of said first insert, and said first tear strip is on said first insert whereby withdrawal of said first insert from said pocket after said tear tab portion is removed automatically unfolds, withdraws and reverses said second insert in lagging relation to said first insert so that information on said second insert formerly facing said other of said front and back panels is now facing toward said one of said front and back panels.

6. The business mailer according to claim 5 wherein said detachable edges on said first tear strip, said tear tab portion and said second insert comprise tear lines.

7. The business mailer according to claim 6, and further comprising a third insert disposed in said pocket between said first and second inserts and having printed information thereon, said third insert having one end free and its opposite end secured to said one edge region of said front and back panels; and a second tear strip having a pair of spaced detachable edges on said third insert adjacent said opposite secured end of said third insert, said second tear strip being secured to said first tear strip on said tear tab portion.

8. The business mailer according to claim 7, and further comprising a fourth insert disposed in said pocket between said first insert and said one of said back and front panels and having printed information thereon, said fourth insert having one end free and its opposite end secured to said one edge region of said back and front panels; and a third tear strip having a pair of spaced detachable edges on said fourth insert adjacent said opposite secured end of said fourth insert, said third tear strip being interposed between and secured to said tear tab portion and said first tear strip.

9. The business mailer according to claim 6 wherein said tear tab portion is on said front panel, the printed information on said first insert faces said front panel, and the printed information on said second insert faces said back panel so that when said first insert is withdrawn from said pocket, said second insert lags behind as it is slowly withdrawn, unfolded and reversed with the printed information thereon now facing toward said front panel where it is readily noticeable.

* * * * *